US010215513B2

(12) United States Patent
Cross

(10) Patent No.: US 10,215,513 B2
(45) Date of Patent: Feb. 26, 2019

(54) AR STYLE RECEIVER COMPATIBLE WITH PISTOL MAGAZINES AND CARTRIDGES

(71) Applicant: Jeffrey Scott Cross, Lexington, TN (US)

(72) Inventor: Jeffrey Scott Cross, Lexington, TN (US)

( * ) Notice: Subject to any disclaimer, the term of this patent is extended or adjusted under 35 U.S.C. 154(b) by 0 days.

(21) Appl. No.: 15/383,610

(22) Filed: Dec. 19, 2016

(65) Prior Publication Data

US 2017/0176119 A1 Jun. 22, 2017

Related U.S. Application Data

(60) Provisional application No. 62/269,650, filed on Dec. 18, 2015, provisional application No. 62/325,011, filed on Apr. 20, 2016.

(51) Int. Cl.

| | |
|---|---|
| ***F41A 3/72*** | (2006.01) |
| ***F41A 3/82*** | (2006.01) |
| ***F41A 3/66*** | (2006.01) |
| ***F41A 35/06*** | (2006.01) |
| ***F41C 23/04*** | (2006.01) |
| ***F41C 23/16*** | (2006.01) |
| ***F41A 19/25*** | (2006.01) |
| ***F41A 17/38*** | (2006.01) |
| *F41A 17/36* | (2006.01) |

(52) U.S. Cl.

CPC ..... *F41A 3/66* (2013.01); *F41A 3/72* (2013.01); *F41A 17/38* (2013.01); *F41A 19/25* (2013.01); *F41A 35/06* (2013.01); *F41C 23/04* (2013.01); *F41C 23/16* (2013.01); *F41A 3/82* (2013.01); *F41A 17/36* (2013.01)

(58) Field of Classification Search

CPC ..... F41A 3/22; F41A 3/24; F41A 3/64; F41A 3/66; F41A 3/68; F41A 3/78; F41A 3/80; F41A 3/82; F41A 15/12; F41A 15/14; F41A 15/16; F41A 19/27; F41A 19/29; F41A 3/72; F41A 3/70; F41A 3/28; F41A 3/26; F41A 3/20; F41A 3/18

See application file for complete search history.

(56) References Cited

U.S. PATENT DOCUMENTS

| | | | | | |
|---|---|---|---|---|---|
| 1,907,163 | A * | 5/1933 | White | F41A 3/44 | 42/75.01 |
| 2,373,761 | A * | 4/1945 | Humeston | F41A 3/82 | 89/191.01 |
| 3,318,192 | A * | 5/1967 | Sullivan | F41A 3/26 | 42/106 |
| 3,618,457 | A * | 11/1971 | Miller | F41A 3/26 | 89/1.4 |
| 3,631,620 | A * | 1/1972 | Ohira | F41A 3/22 | 42/16 |

(Continued)

*Primary Examiner* — Derrick R Morgan
(74) *Attorney, Agent, or Firm* — Eversheds Sutherland (US) LLP

(57) ABSTRACT

A firearm compatible with pistol magazines and cartridges is disclosed. The firearm may include an upper receiver. The firearm also may include a bolt carrier having at least one fixed bolt carrier key extending therefrom. In addition, the firearm may include a recoil spring guide rod. The at least one bolt carrier key may be slidably attached to the recoil spring guide rod. A recoil spring may be disposed on the recoil spring guide rod between the at least one bolt carrier key and a recoil bumper.

14 Claims, 16 Drawing Sheets

(56) References Cited

U.S. PATENT DOCUMENTS 3,857,322 A * 12/1974 Lichtman ..... F41A 3/82 42/15
4,142,314 A * 3/1979 Foote ..... F41A 3/82 42/16
4,358,986 A * 11/1982 Giorgio ..... F41A 3/26 89/1.4
4,553,469 A * 11/1985 Atchisson ..... F41A 3/46 42/25
6,019,024 A * 2/2000 Robinson ..... F41A 3/72 89/1.42
7,231,861 B1 * 6/2007 Gauny ..... F41A 3/72 42/16
7,798,045 B1 * 9/2010 Fitzpatrick ..... F41A 21/481 42/69.02
7,819,052 B2 * 10/2010 Zedrosser ..... F41A 35/06 89/1.4
7,950,178 B1 * 5/2011 Landies ..... F41A 19/27 42/69.01
8,307,747 B2 * 11/2012 Fitzpatrick ..... F41A 9/38 42/14
8,561,517 B2 * 10/2013 Brown ..... F41A 3/72 89/1.4
8,590,199 B2 * 11/2013 Overstreet ..... F41A 3/12 42/69.02
8,661,963 B2 * 3/2014 Patel ..... F41A 3/66 42/16
9,032,860 B2 * 5/2015 Faxon ..... F41A 15/14 89/193
9,188,401 B2 * 11/2015 Pizano ..... F41A 7/02
9,448,020 B1 * 9/2016 Olson ..... F41A 3/66
9,605,917 B2 * 3/2017 Withey ..... F41A 3/22
9,857,136 B2 * 1/2018 Hayes ..... F41A 21/10
2002/0046642 A1 * 4/2002 Murello ..... F41A 3/72 89/1.42
2005/0132875 A1 * 6/2005 Murello ..... F41A 3/46 89/198
2007/0006720 A1 * 1/2007 Liao ..... F41A 3/54 89/1.4
2010/0000396 A1 * 1/2010 Brown ..... F41A 3/72 89/1.4
2012/0204713 A1 * 8/2012 Patel ..... F41A 3/66 89/199
2014/0013641 A1 * 1/2014 Warburton ..... F41A 3/22 42/16
2014/0224114 A1 * 8/2014 Faxon ..... F41A 15/14 89/193
2015/0059221 A1 * 3/2015 Bero ..... F41A 3/66 42/16
2015/0247688 A1 * 9/2015 Zonshine ..... F41A 3/58 42/8
2015/0276333 A1 * 10/2015 DiOrio ..... F41A 3/24 42/16
2016/0245603 A1 * 8/2016 Pizano ..... F41A 5/26
2016/0348990 A1 * 12/2016 Steil ..... F41A 5/18
2016/0370135 A1 * 12/2016 Plumb ..... F41A 3/78
2017/0122685 A1 * 5/2017 Kolev ..... F41A 19/10
2017/0254606 A1 * 9/2017 Withey ..... F41A 3/22
2017/0328660 A1 * 11/2017 McGinty ..... F41A 3/26

* cited by examiner

AR STYLE RECEIVER COMPATIBLE WITH PISTOL MAGAZINES AND CARTRIDGES

CROSS-REFERENCE TO RELATED APPLICATIONS

The disclosure claims priority to and the benefit of U.S. provisional patent application No. 62/269,650, filed Dec. 18, 2015, which is herein incorporated by reference in its entirety. The disclosure also claims priority to and the benefit of U.S. provisional patent application No. 62/325,011, filed Apr. 20, 2016, which is herein incorporated by reference in its entirety.

FIELD

The disclosure generally relates to firearms and more particularly relates to an AR style receiver that is compatible with pistol magazines and cartridges.

BACKGROUND

AR-15 style firearms are a popular firearm platform. These firearms include an upper receiver and a lower receiver. Pistols are another popular firearm platform. Pistol cartridges cannot typically be fired from an AR-15 style firearm. This is unfortunate since pistol cartridges may be cheaper and more widely available. Therefore, there is a need for an AR style firearm that is compatible with pistol magazines and cartridges.

BRIEF DESCRIPTION OF THE DRAWINGS

The detailed description is set forth with reference to the accompanying drawings. The use of the same reference numerals may indicate similar or identical items.

DETAILED DESCRIPTION

Figure 1:
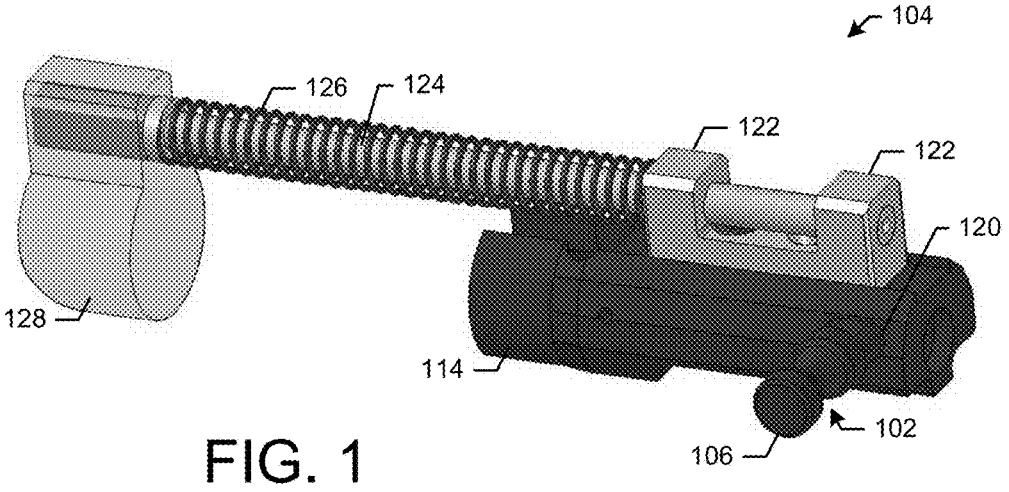
FIG. 1 depicts a bolt carrier, recoil system, and charging handle in accordance with one or more embodiments of the disclosure.

The detailed description is set forth with reference to the accompanying drawings. The drawings depict an AR style receiver that is compatible with pistol magazines and cartridges in accordance with one or more embodiments of the disclosure. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

Described below are embodiments of a firearm 100 (as well as individual components of the firearm). In some instances, the firearm 100 may be a submachine gun. Methods of manufacturing, installing, and using the firearm 100 are also disclosed. The firearm 100 may be similar to an AR-15 style rifle. The firearm may include an upper receiver 101 and a lower receiver 103.

Figure 2:
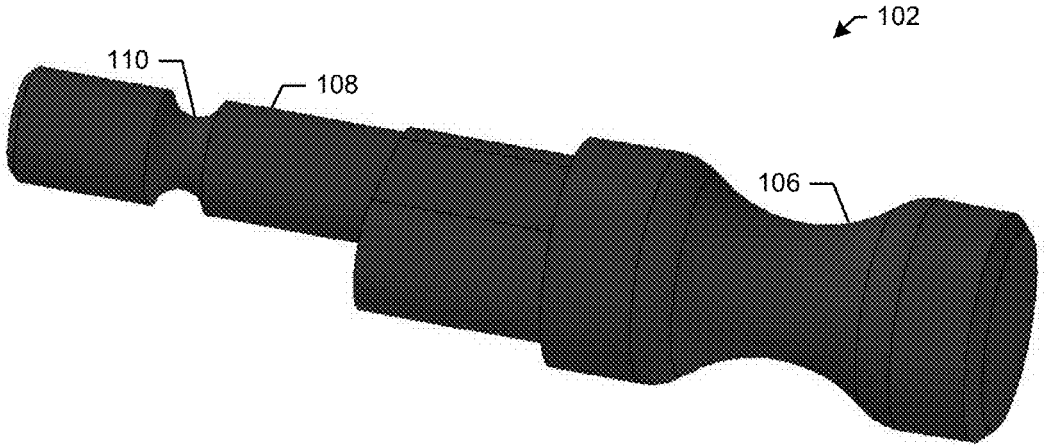
FIG. 2 depicts a charging handle knob in accordance with one or more embodiments of the disclosure.
Figure 3:
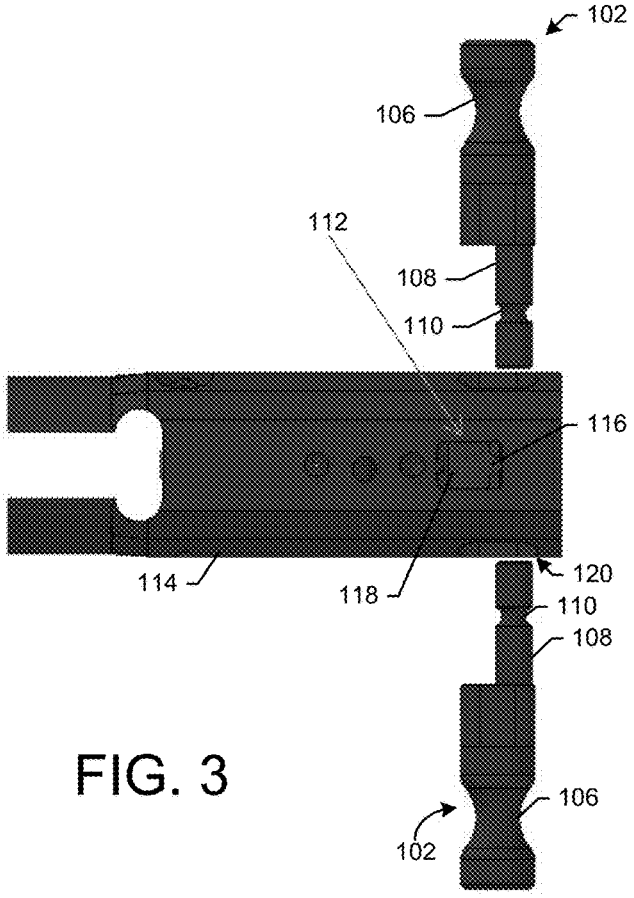
FIG. 3 depicts a bolt carrier and charging handle knobs in accordance with one or more embodiments of the disclosure.
Figure 4:
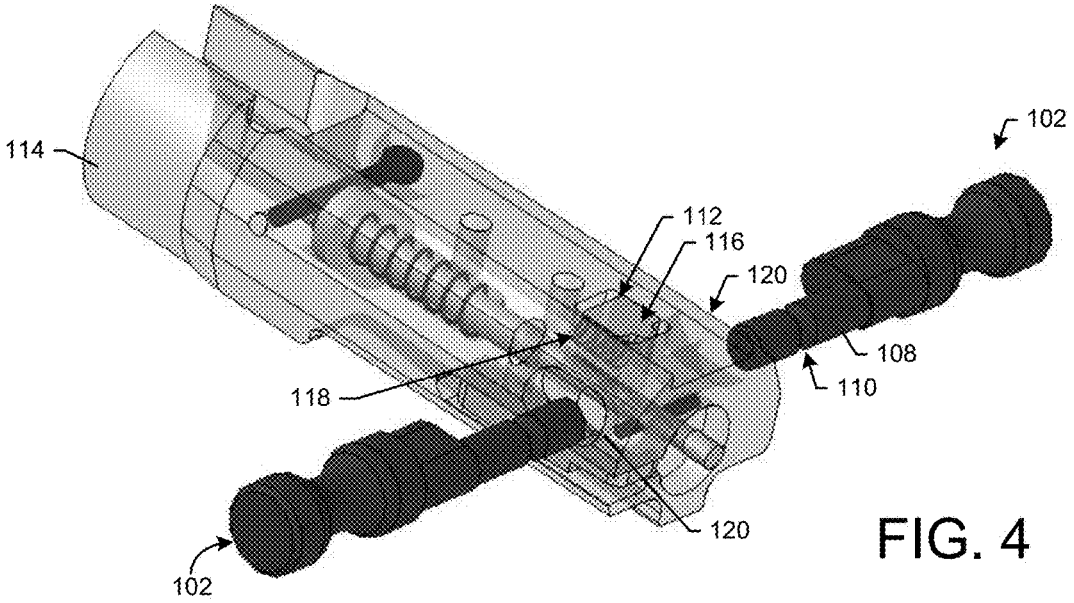
FIG. 4 depicts a bolt carrier and charging handle knobs in accordance with one or more embodiments of the disclosure.
Figure 5:
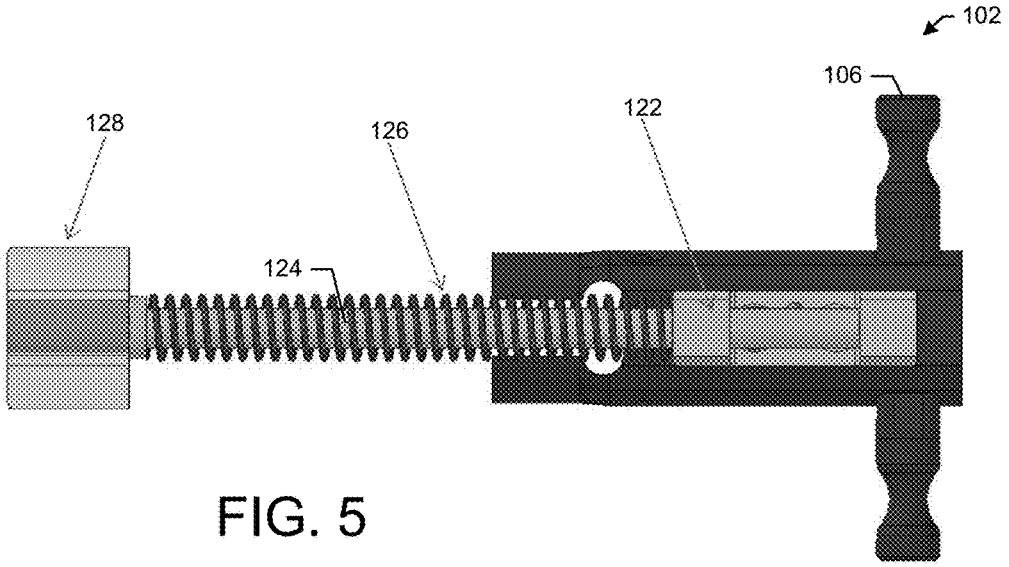
FIG. 5 depicts a bolt carrier, recoil system, and charging handle in accordance with one or more embodiments of the disclosure.
Figure 6:
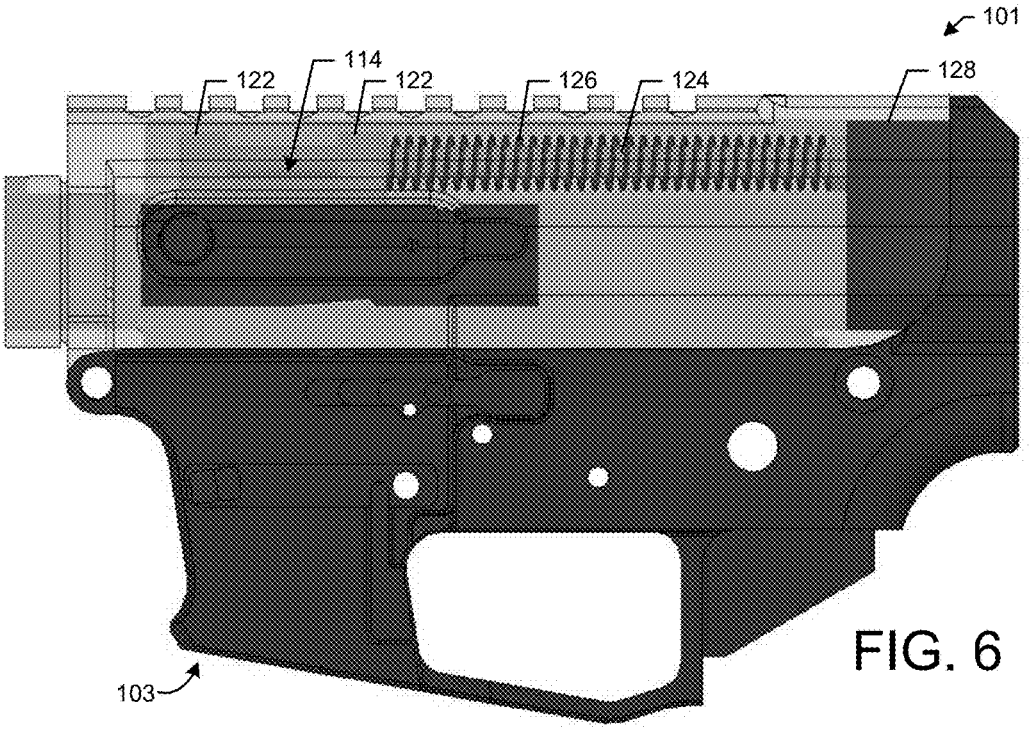
FIG. 6 depicts a bolt carrier and recoil system in accordance with one or more embodiments of the disclosure.

As depicted in FIGS. 1-4, the upper receiver 101 of the firearm 100 may include one or more ambidextrous charging knobs 102 for a rear charging handle 104. The charging knobs 102 may be inserted and/or removed from either side of the firearm 100 without the use of tools. For example, as depicted in FIG. 2, the charging knobs 102 may include a handle portion 106 with a protrusion 108 extending therefrom. The protrusion 108 may include a circular groove 110 configured to mate with a spring loaded detent 112 within the bolt carrier 114. As depicted in FIGS. 3 and 4, the spring loaded detent 112 may be disposed within a cavity in the bolt carrier group 114. The spring loaded detent 112 may include a detent portion 116 and a spring 118. The spring 118 may push the detent portion 116 forward. For example, the spring loaded detent 112 may compress as the protrusion 108 of the charging knob 102 is inserted through an opening 120 into the bolt carrier 114. When the spring loaded detent 112 aligns with the circular groove 110, the spring loaded detent 112 may spring forward, causing the detent portion 116 to be captured within the circular groove 110. The charging knob 102 can be removed from the bolt carrier 114 by pulling thereon with enough force to overcome the spring force of the spring 118 of the spring loaded detent 112 from the circular groove 110. In this manner, the charging knob 102 may be inserted on either side of the bolt carrier 114.

As depicted in FIGS. 1, 5, 6, and 7, the bolt carrier 114 may include at least one, and preferably two, fixed bolt carrier keys 122 extending therefrom that are slidably attached to a recoil spring guide rod 124. The bolt carrier keys 122 may form a U-shaped channel. A bolt 135 may be attached to the recoil spring guide rod 124 to prevent the bolt carrier keys 122 from sliding off of the recoil spring guide rod 124 under the pressure of the spring guide rod 124. The bolt carrier keys 122 may be fixably attached to the bolt carrier 114. The bolt carrier keys 122 may be any size, shape, or configuration. A recoil spring 126 may be disposed on the recoil spring guide rod 124 between the bolt carrier keys 122 and a recoil bumper 128. The bolt carrier 114 via the bolt carrier keys 122 may recoil rearward along the recoil spring guide rod 124 when the firearm is discharged or when the front or rear charging handle is pulled. The recoil spring 126 may bias the bolt carrier 114 in the forward position.

Figure 7:
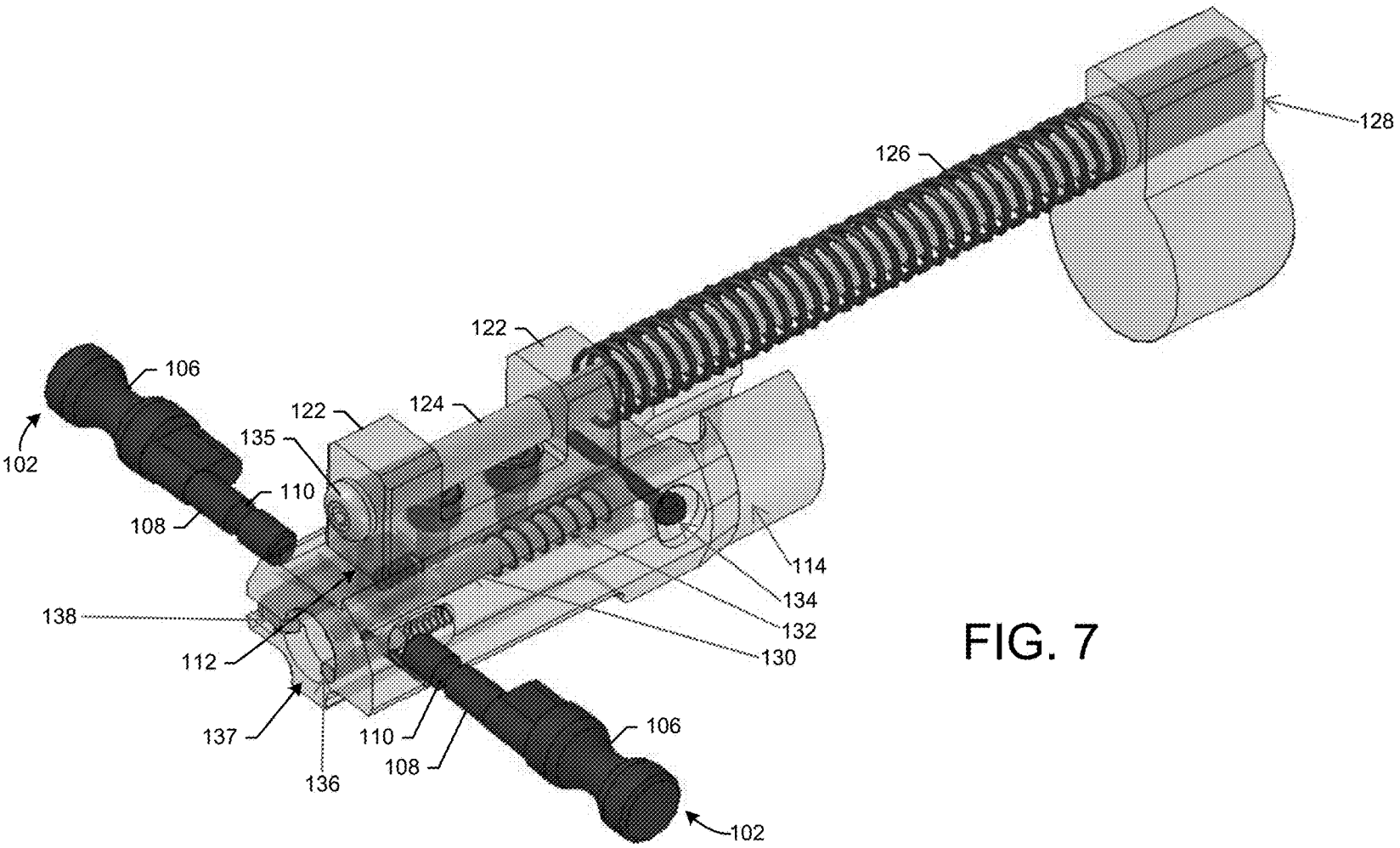
FIG. 7 depicts a bolt carrier, recoil system, and charging handle in accordance with one or more embodiments of the disclosure.

Referring to FIG. 7, the bolt carrier 114 may include a firing pin 130, a firing pin spring 132 disposed about the firing pin 130, and a firing pin retaining clip 134 therein. The firing pin spring 132 biases the firing pin 130 away from an engaged cartridge disposed at least partially in opening 137. The firing pin 130 includes an enlarged strike face, which a hammer of a trigger may strike to initiate the firing of the firearm 100. The bolt carrier 114 also may include an ejector 136 and case extractor 138. The ejector 136 may be an AR style ejector. In one particular embodiment, the ejector 136 and the case extractor 138 are designed to be compatible with pistol rounds, such as 9mm 45 caliber, or other pistol rounds. Likewise, the opening 137 may include a diameter and depth compatible with pistol rounds in cooperation with the ejector 136 and the case extractor 138.

Figure 8:
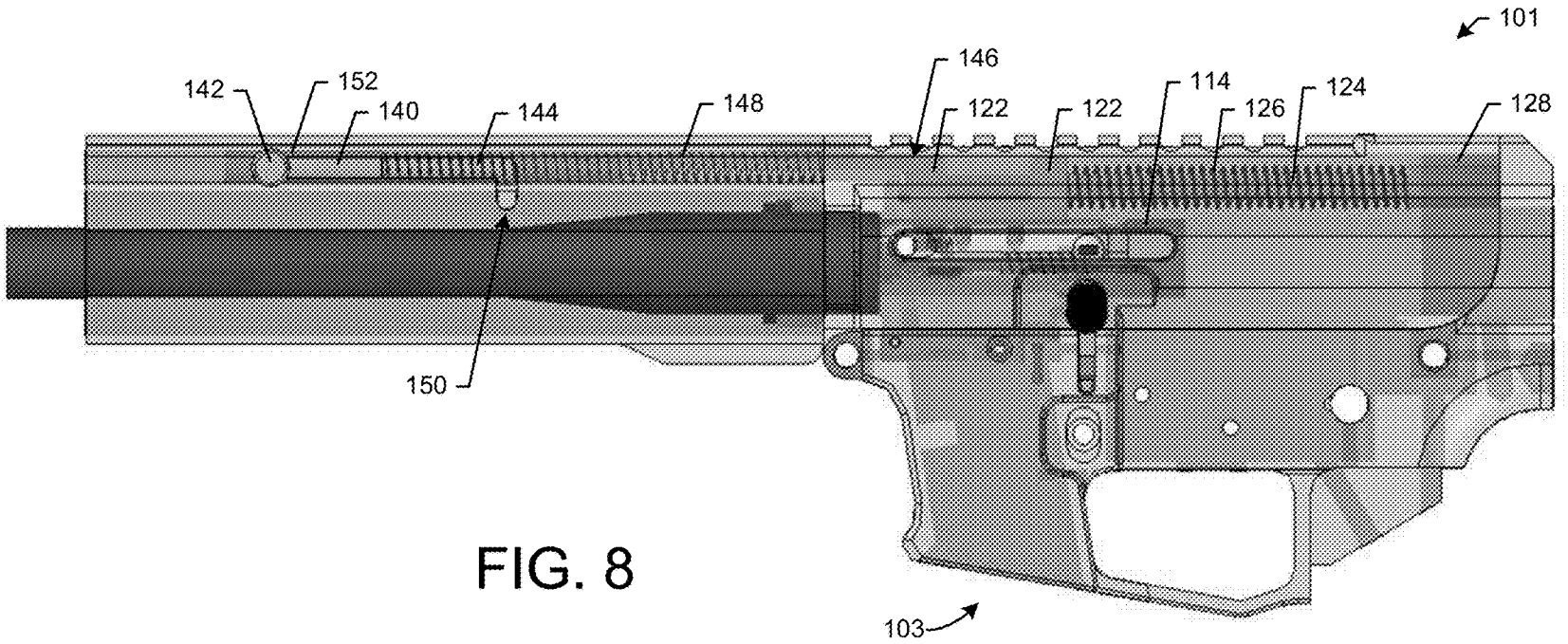
FIG. 8 depicts a forward charging handle in accordance with one or more embodiments of the disclosure.
Figure 9:
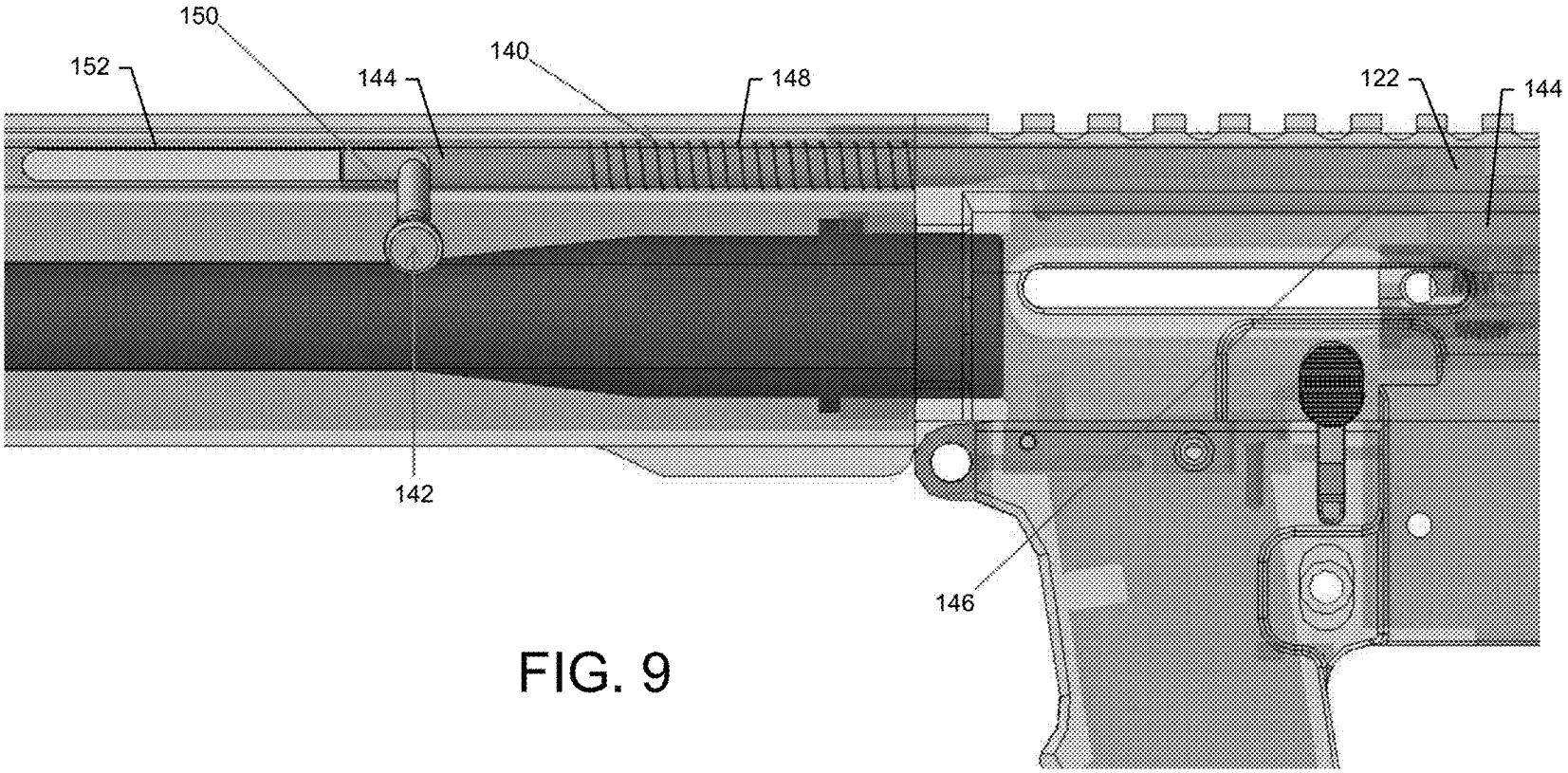
FIG. 9 depicts a forward charging handle in accordance with one or more embodiments of the disclosure.

As depicted in FIGS. 8 and 9, the upper receiver 101 of the firearm 100 may include a forward charging handle 140. The forward charging handle 140 may be a non-reciprocating charging handle. The forward charging handle 140 may include a handle 142 attached to a rod 144. The rod 144 may engage the bolt carrier key 114 to drive the bolt carrier 114 rearward. The rod 144 may contact the carrier key 122 at engagement point 146. A return spring 148 may be disposed about the rod 144 of the forward charging handle 140. The forward charging handle 140 can lock the bolt carrier 114 in the rearward position by way of a locking slot 150. That is, the handle 142 may be disposed within a guide slot 152. The locking slot 150 may be disposed at the rear of the guide slot 152. In this manner, a user may grasp the handle 142 and pull the handle along the guide slot 152 rearward until the handle is disposed within the locking slot 150. As the handle 142 is pulled rearward, the rod 144 may push against the forward carrier key 122 of the bolt carrier 114 to move the bolt carrier 114 rearward. The return spring 148 may move the forward charging handle 140 forward once the handle 142 is removed from the locking slot 150. In some instances, the recoil spring 126 may move the bolt carrier 114 forward as well.

Figure 10:
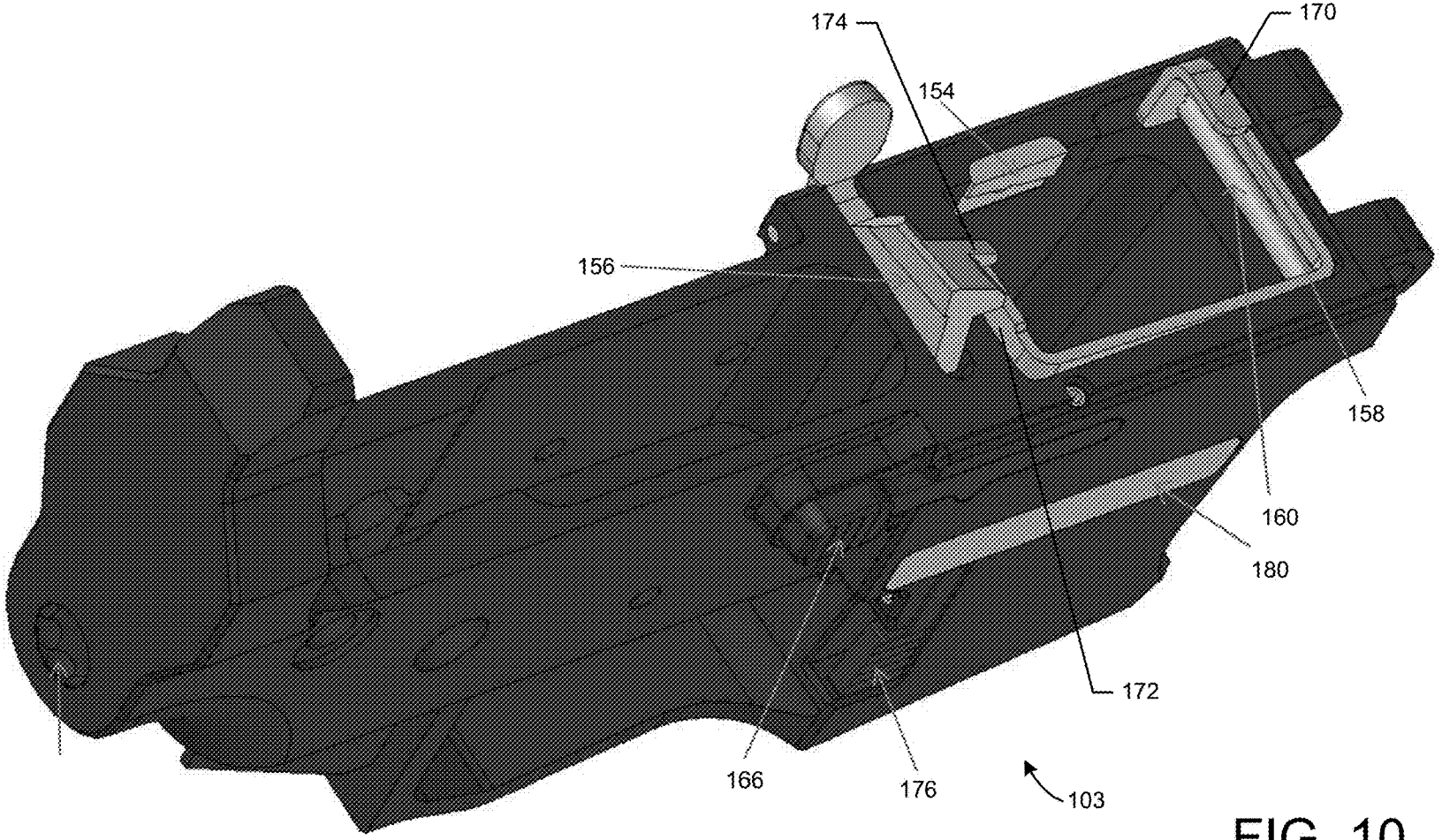
FIG. 10 depicts a lower receiver in accordance with one or more embodiments of the disclosure.
Figure 11:
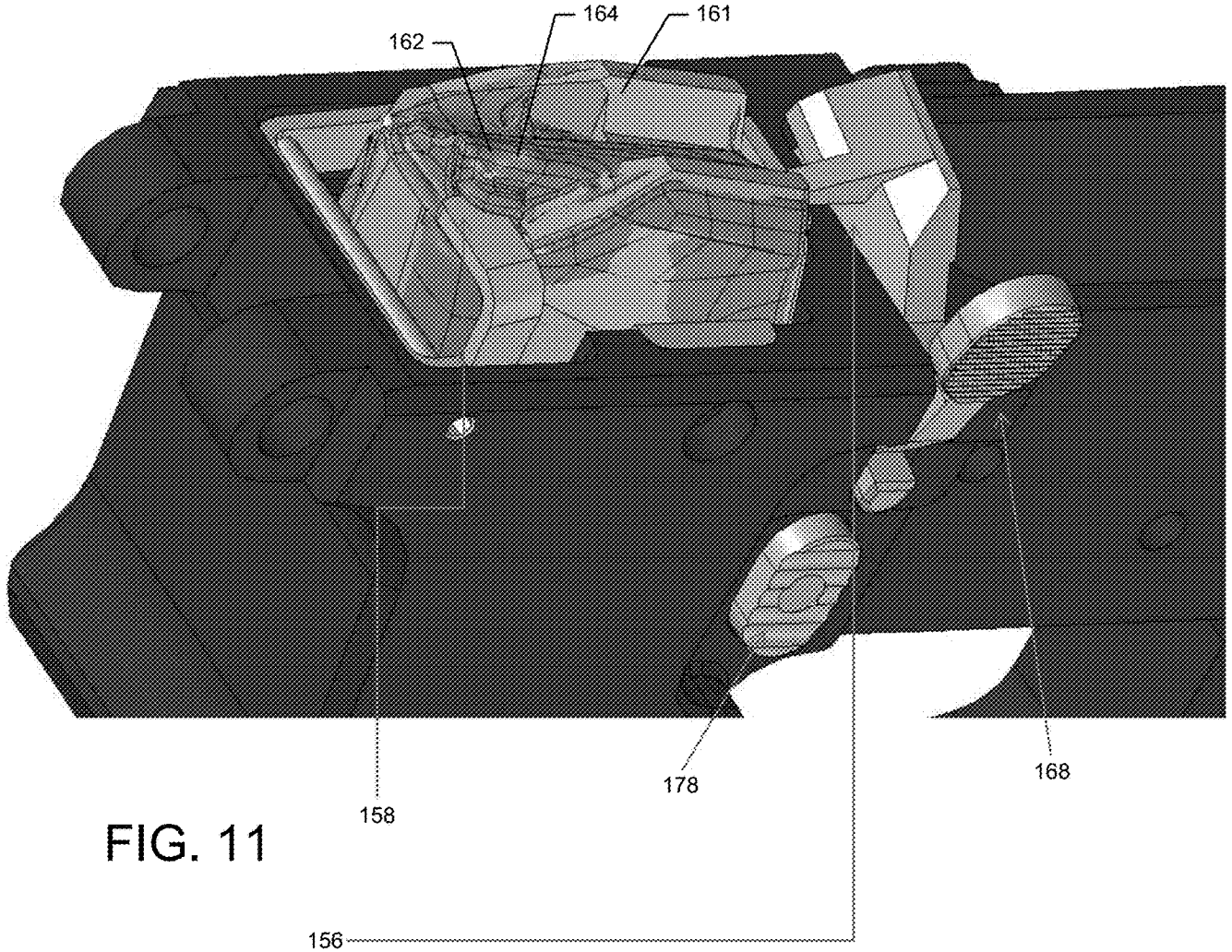
FIG. 11 depicts a lower receiver in accordance with one or more embodiments of the disclosure.
Figure 12:
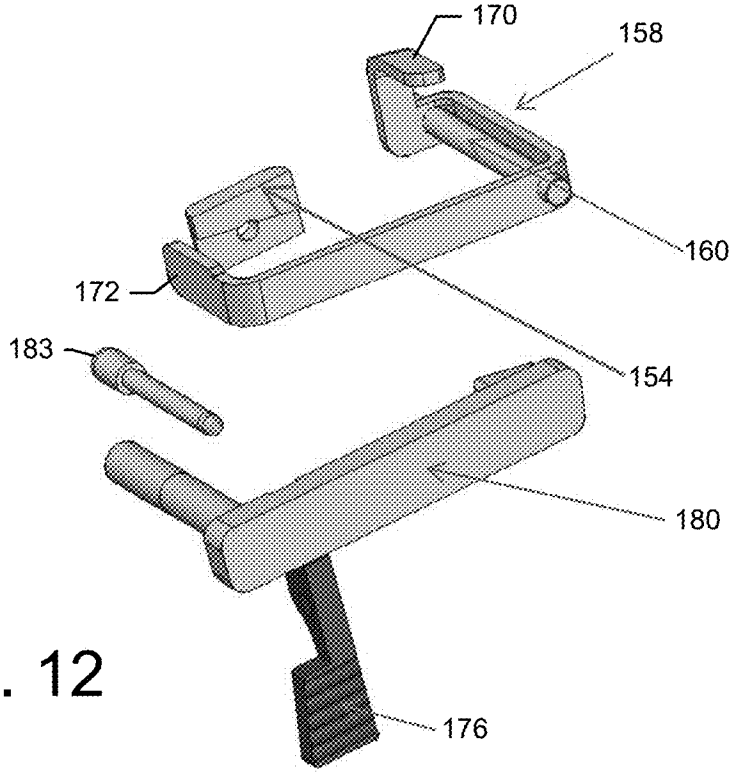
FIG. 12 depicts a number of components of a lower receiver in accordance with one or more embodiments of the disclosure.

As depicted in FIGS. 10-12, the lower receiver 103 of the firearm 100 may include a magazine insertion stop insert 154. The lower receiver 103 also may include a bolt catch 156. The bolt catch 156 may pivot between an up and down position. In the up position, the bolt catch 156 may maintain the bolt carrier 114 in the rearward position. A last round bolt hold arm 158 may pivot about a pivot pin 160 to push the bolt catch 156 into the up position after the last round is dispensed from the magazine 161. That is, the pad on 162 the magazine follower 164 may contact the last round bolt hold arm 158, causing it to pivot, which in turn may cause the bolt catch 156 to pivot into the up position. For example, the last round bolt hold arm 158 may include a first contact arm 170, which may contact the pad 162 on the magazine follower 164, which may cause the first contact arm 170 to pivot upward around the pivot pin 160. This in turn may cause a second contact arm 172, which is also pivotally attached to the pivot point 160, to pivot upward. As the second contact arm 172 pivots upward, it may contact a lip 174 of the bolt catch 156, which may cause the bolt catch 156 to move upward to catch the bolt carrier 114. The bolt catch 156 may include an ambidextrous bolt catch release mechanism that enables a user to move the bolt catch 156 to the down position on either side of the lower receiver 103. For example, the ambidextrous bolt catch release mechanism may include a first release button 166 on one side and a second release button 168 on another side. The second release button 168 may engage a release rod 183. Similarly, the lower receiver 103 may include an ambidextrous magazine release mechanism that enables a user to release the magazine 161 from either side of the lower receiver 103. The ambidextrous magazine release mechanism may include a first release button 176 on one side and a second release button 178 on another side. The first release button 176 may be attached to a magazine catch arm 180.

Figure 13:
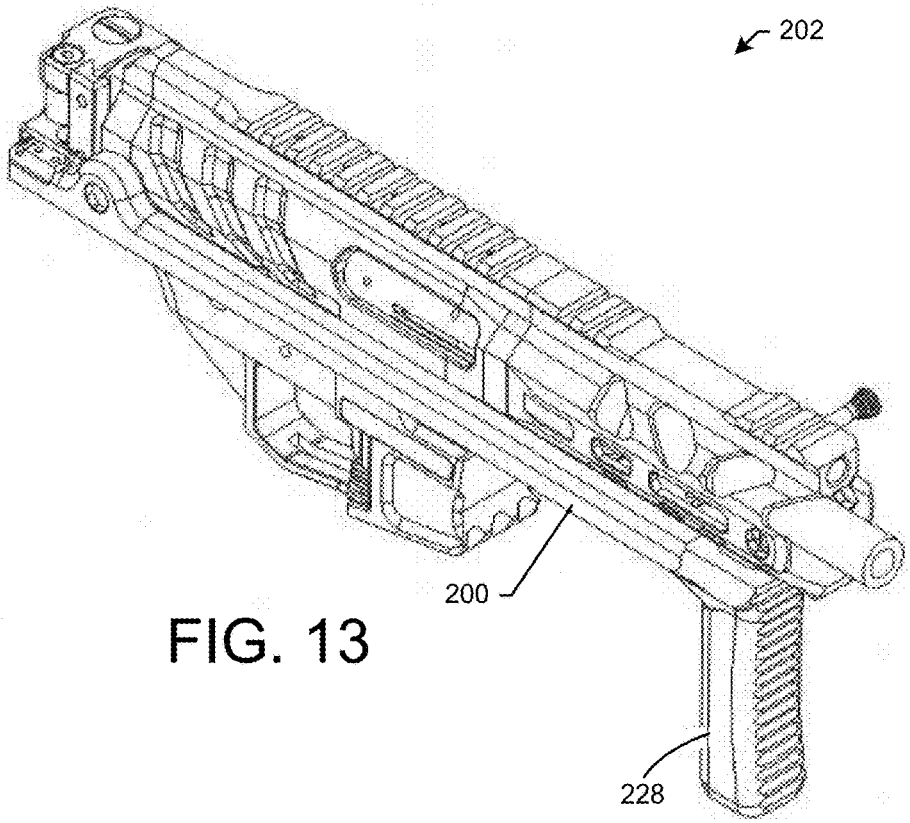
FIG. 13 depicts a firearm in accordance with one or more embodiments of the disclosure.
Figure 14:
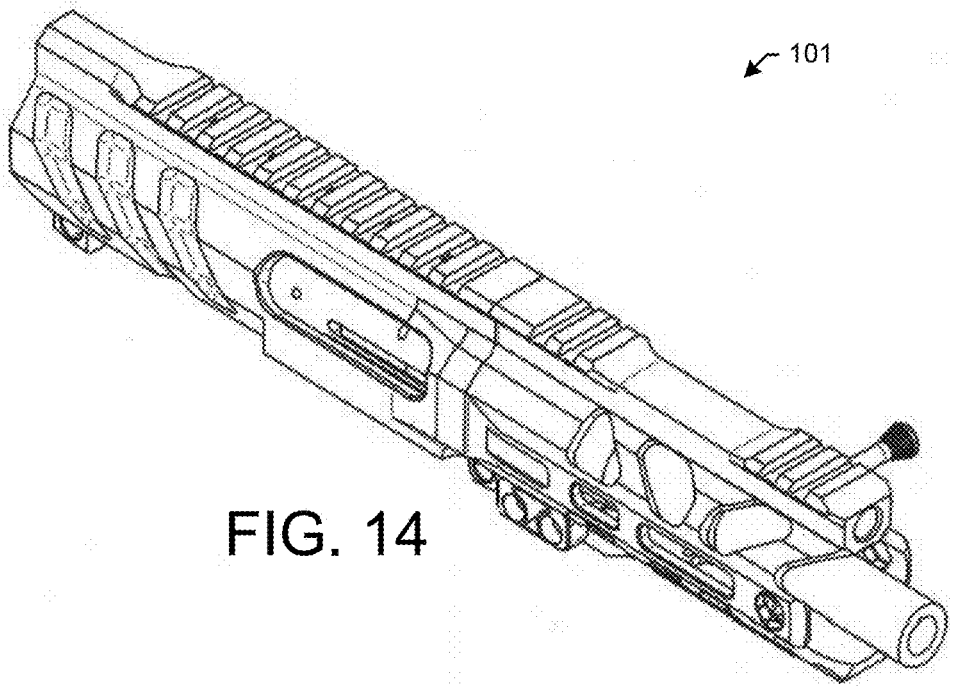
FIG. 14 depicts an upper receiver in accordance with one or more embodiments of the disclosure.
Figure 15:
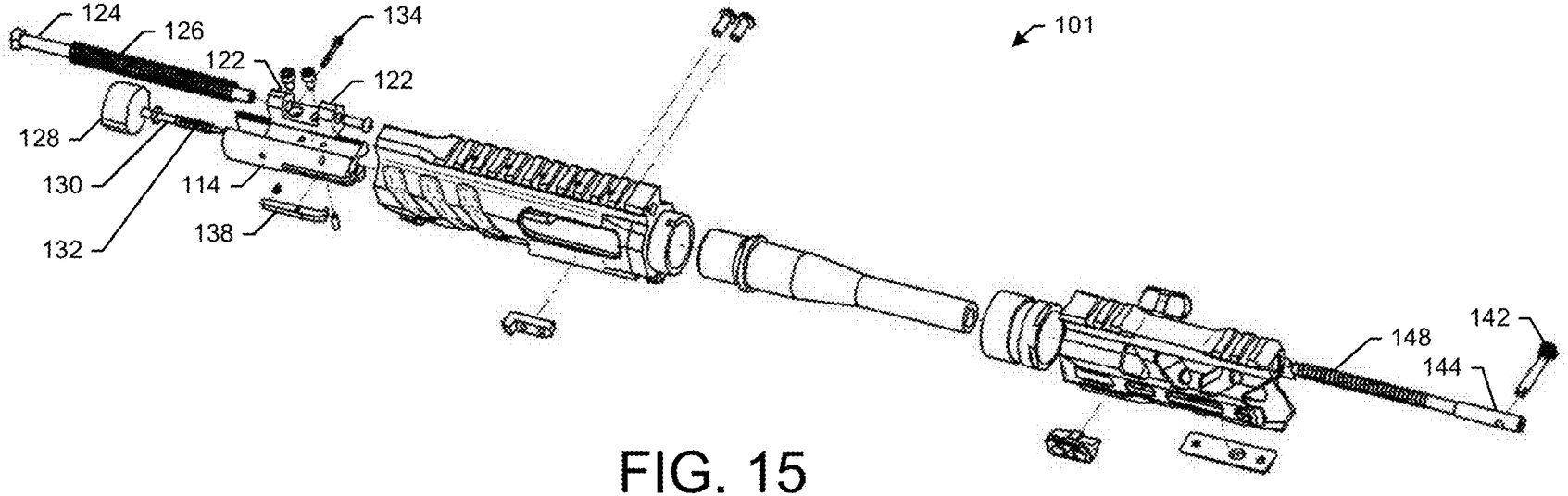
FIG. 15 depicts an exploded view of an upper receiver in accordance with one or more embodiments of the disclosure.
Figure 16:
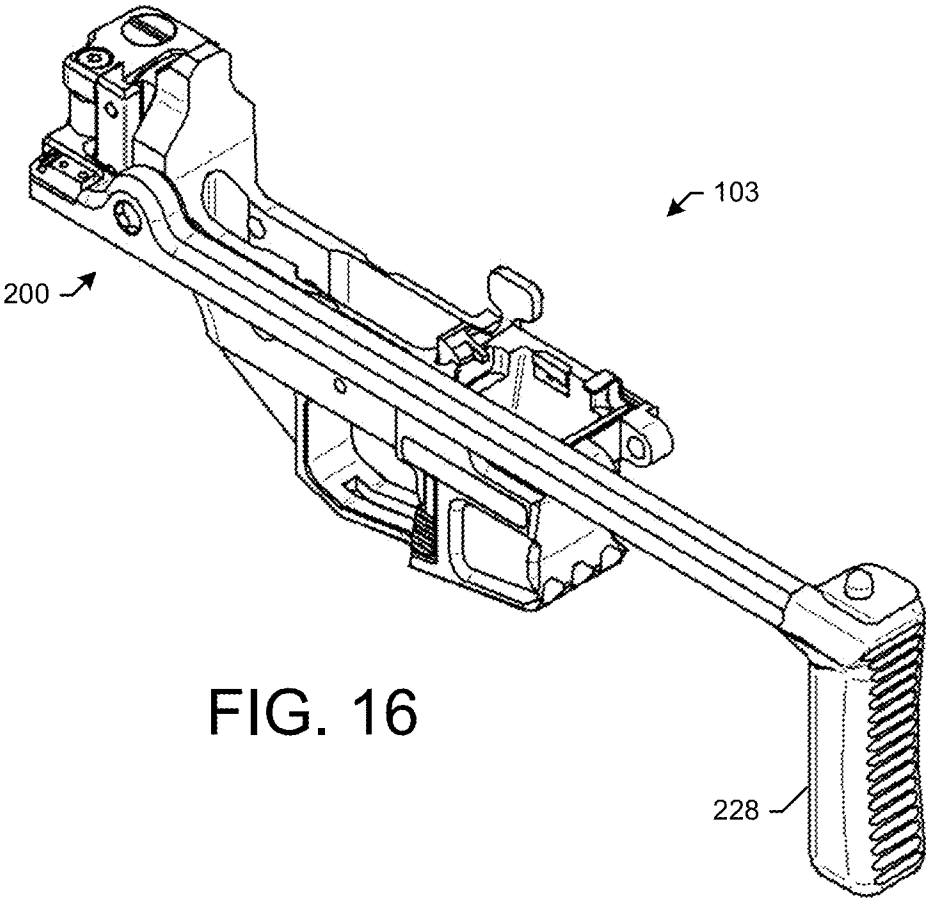
FIG. 16 depicts a lower receiver in accordance with one or more embodiments of the disclosure.

FIGS. 13-17 depict an example embodiment of the firearm 202. The firearm 202 may include all of the components described above with regard to the firearm 100. In addition, as depicted in FIGS. 13 and 16-20, the firearm 202 may include a convertible stock 200 that can be folded from a buttstock (as shown in FIG. 18) into a forward grip (as shown in FIG. 13) and vice versa. Methods of installing the convertible stock 200 on the firearm 202 are also disclosed. The firearm 202 may be the same as the firearm 100. In addition, the convertible stock 200 may be attached to a conventional firearm. For example, the convertible stock 200 may be attached to an M-16 style rifle, an AR-15 style rifle, an AR-10 style rifle, or an M-4 style rifle, among others. In some instances, the convertible stock 200 may be attached to a shotgun. Any type of firearm may incorporate the convertible stock 200.

Figure 17:
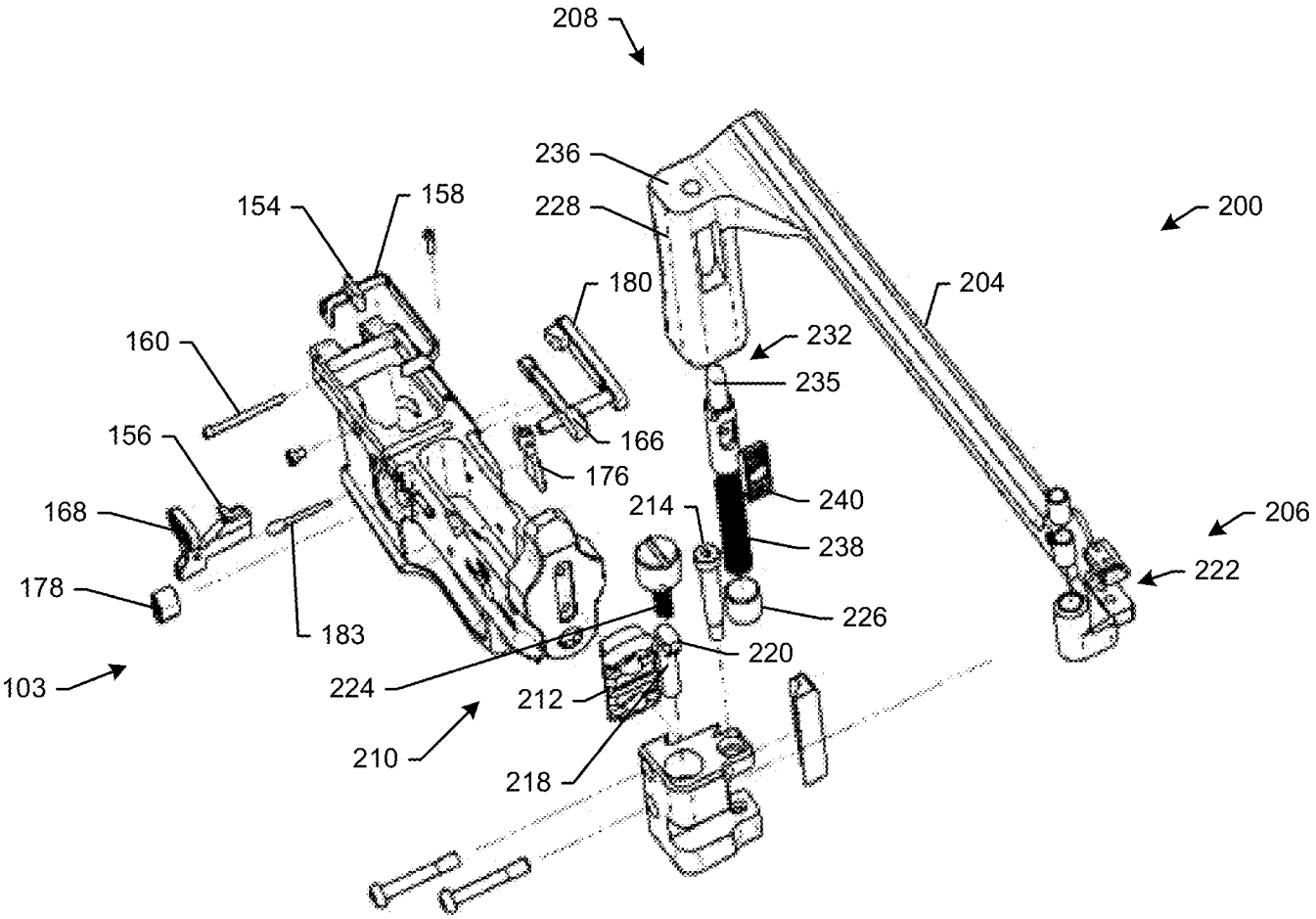
FIG. 17 depicts an exploded view of a lower receiver in accordance with one or more embodiments of the disclosure.
Figure 18:
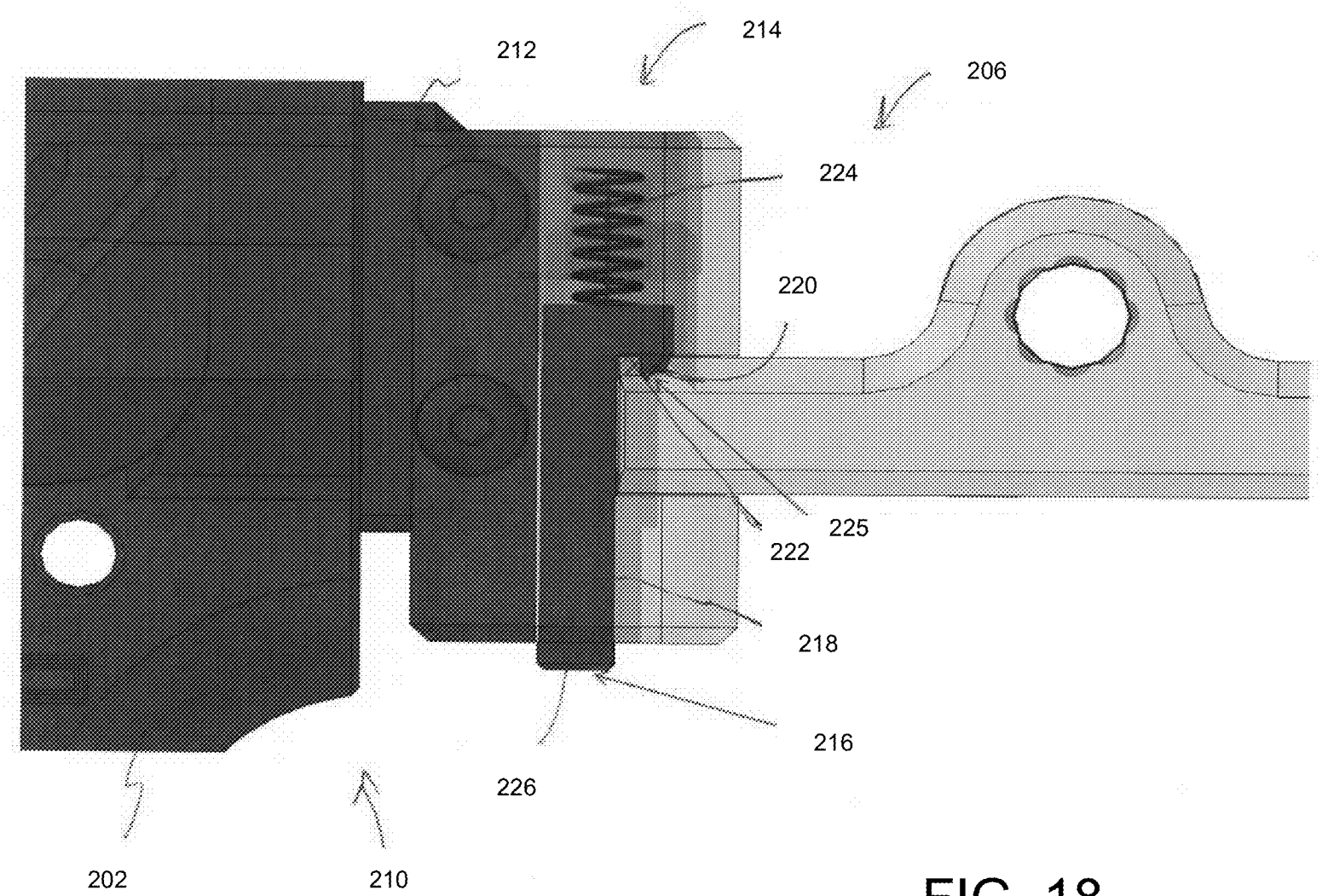
FIG. 18 depicts a portion of a convertible stock in the extended position in accordance with one or more embodiments of the disclosure.
Figure 19:
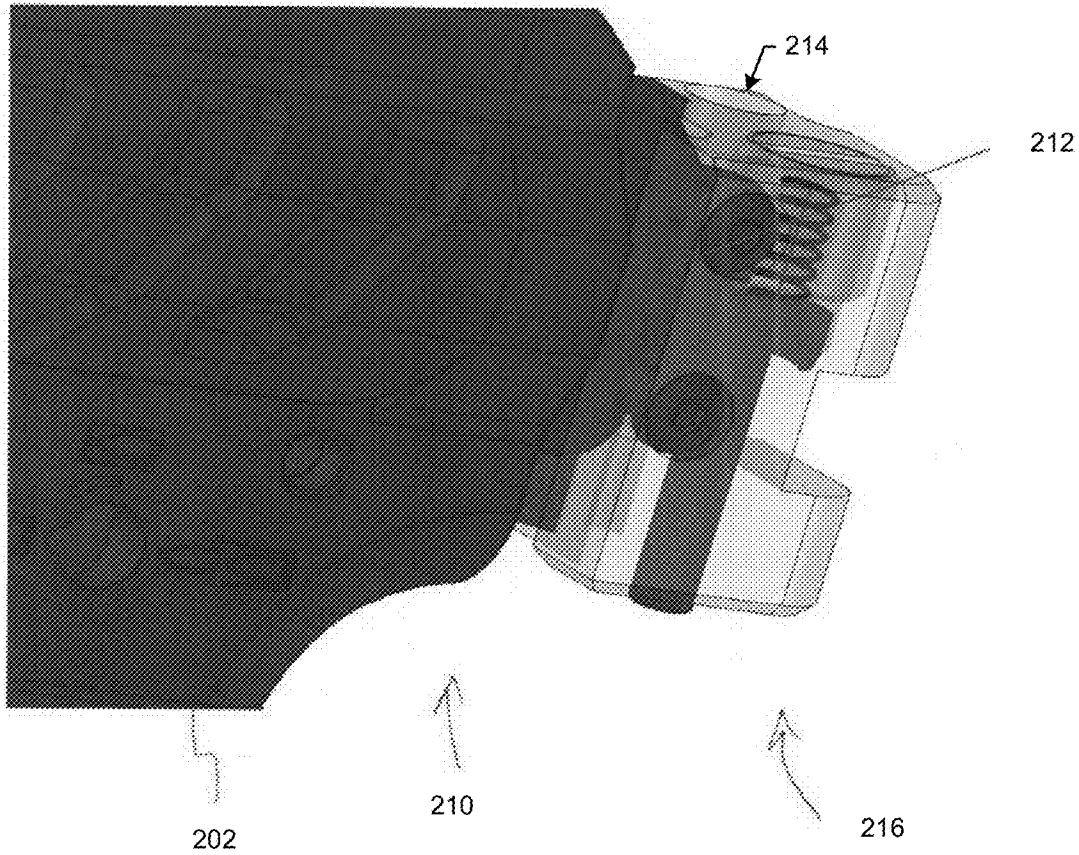
FIG. 19 depicts a portion of a convertible stock in the folded position in accordance with one or more embodiments of the disclosure.

As depicted in FIGS. 17-19, the convertible stock 200 may include an elongated body 204 having a first end 206 and a second end 208. The first end 206 of the elongated body 204 may be attached to the firearm 202. The first end 206 of the elongated body 204 may be attached at any location on the firearm 202. In some instances the first end 206 of the elongated body 204 may be attached to a rear portion 210 of the firearm 202. For example, the first end 206 of the elongated body 204 may be mounted to a rail 212 of the firearm 202. In one example, the first end 206 of the elongated body 204 may be mounted to a Picatinny rail or the like. The first end 206 of the elongated body 204 may be mounted to any rail.

The first end 206 of the elongated body 204 may include an axial 214 (or other hinge) that the elongated body 204 rotates about. In this manner, the convertible stock 200 may include an unfolded (or extended) position and a folded (or retracted) position.

The first end 206 of the elongated body 208 may include a first locking assembly 216 for locking the convertible stock 200 in the unfolded position. The first locking assembly 216 may include a locking pin 218 with a tab 220. The tab 220 may be configured to mate with a slot 222 in the first end 206 of the elongated body 204. The tab 220 may be maintained in the slot 222 by a spring 224. In this manner, the locking pin 218 and tab 220 may be spring loaded. In order to disengage the tab 220 from the slot 222, a user may press an end 226 of the locking pin 218 opposite the end 225 of the tab 220 to overcome the spring force applied to the locking pin 218 and tab 220. Once the tab 220 is removed from the slot 222, the convertible stock 200 may be rotated into the folded position. Conversely, the convertible stock

200 may be rotated from the folded position to the unfolded position until the tab 220 is aligned with the slot 222, at which point the spring 224 may force the tab 220 into the slot 222 to lock the convertible stock 200 in the unfolded position.

Figure 20:
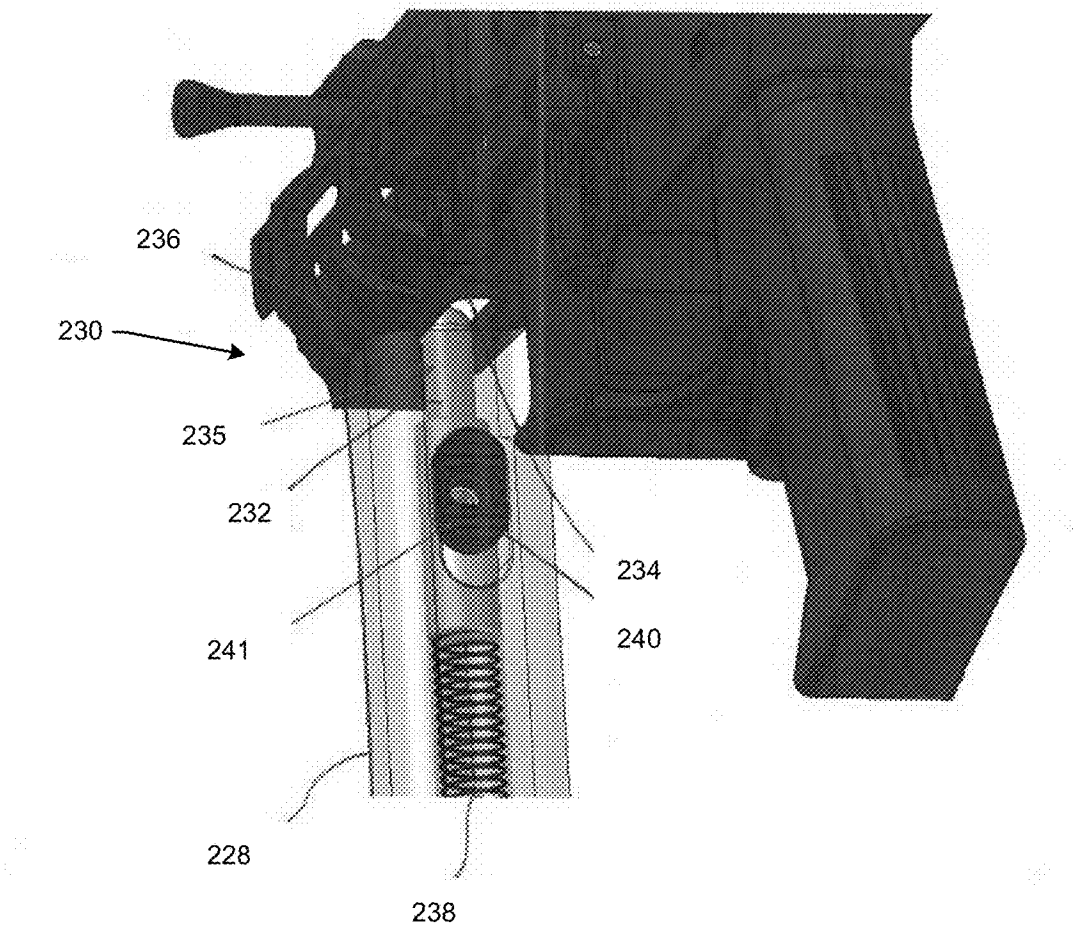
FIG. 20 depicts a portion of a convertible stock in the folded position in accordance with one or more embodiments of the disclosure.

As depicted in FIG. 20, the second end 208 of the elongated body 204 may include a substantially traverse stabilizing member 228. In the unfolded position, the stabilizing member 228 may function as a buttstock. In the folded position, the stabilizing member 228 may function as a forward grip. For example, the stabilizing member 228 may include a second locking assembly 230 for locking the convertible stock 200 in the folded position. The second lock assembly 230 may include a detent 232 having a protrusion 235 configured to mate with a slot 234 in the forend of the firearm 202. For example, the stabilizing member 228 may include a ledge 236 with the detent 232 partially extending therefrom. The detent 232 may be maintained in the slot 234 by a spring 238. In this manner, the detent 232 may be spring loaded. In order to disengage the detent 232 from the slot 234, a user may slide 241 a button 240 attached to the detent 232 to overcome the spring force applied to the detent 232. Once the detent 232 is removed from the slot 234, the convertible stock 200 may be rotated into the unfolded position. Conversely, the convertible stock 200 may be rotated from the unfolded position to the folded position until the detent 232 is aligned with the slot 234, at which point the spring 238 may force the detent 232 into the slot 234 to lock the convertible stock 200 in the folded position.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A firearm compatible with pistol magazines and cartridges, comprising:

an upper receiver;

a bolt carrier comprising a bolt carrier key attached thereto and extending therefrom, wherein the bolt carrier key comprises a forward protrusion and a rear protrusion forming a U-shaped channel;

a recoil spring guide rod slidably attached to the bolt carrier key through the forward protrusion and the rear protrusion;

a recoil spring disposed on the recoil spring guide rod between the rear protrusion of the bolt carrier key and a recoil bumper;

a fastener attached to the recoil spring guide rod opposite the recoil bumper, wherein the fastener is configured to prevent the bolt carrier key from sliding off of the recoil spring guide rod under the pressure of the recoil spring;

a forward charging handle comprising a handle attached to a charging rod, wherein the charging rod is configured to engage the forward protrusion of the bolt carrier key to drive the bolt carrier rearward, wherein the handle is disposed within a guide slot;

a return spring disposed about the charging rod; and a locking slot disposed at a rear end of the guide slot;

wherein the handle is slidable along the guide slot rearward until the handle is disposed within the locking slot, wherein as the handle is moved rearward, the charging rod is configured to push against the forward protrusion of the carrier key to move the bolt carrier rearward, wherein the return spring moves the forward charging handle forward once the handle is removed from the locking slot, and wherein the forward charging handle is a non-reciprocating charging handle.

2. The firearm of claim 1, further comprising:

one or more ambidextrous charging knobs for a rear charging handle;

wherein the charging knobs comprise a handle portion with a protrusion extending therefrom;

wherein the protrusion comprises a circular groove configured to mate with a spring loaded detent within the bolt carrier; and wherein the charging knobs are insertable or removable from either side of the firearm.

3. The firearm of claim 2, wherein the spring loaded detent comprises a detent portion and a spring, wherein the spring loaded detent compresses as the protrusion is inserted through an opening in the bolt carrier, wherein when the spring loaded detent aligns with the circular groove, the spring loaded detent springs forward, causing the detent portion to be captured within the circular groove.

4. The firearm of claim 3, wherein the charging knob is removable from the bolt carrier by pulling thereon with enough force to overcome the spring force of the spring of the spring loaded detent from the circular groove.

5. The firearm of claim 1, wherein the bolt carrier comprises a firing pin, a firing pin spring, and a firing pin retaining clip therein.

6. The firearm of claim 5, wherein the bolt carrier comprises an AR style ejector and case extractor.

7. The firearm of claim 1, further comprising:

a lower receiver;

a magazine insertion stop insert;

a bolt catch, wherein the bolt catch pivots between an up and down position, wherein in the up position, the bolt catch maintains the bolt carrier in the rearward position;

a last round bolt hold arm pivots about a pivot pin to push the bolt catch into the up position after the last round is dispensed from the magazine.

8. The firearm of claim 7, wherein the last round bolt hold arm comprises a first contact arm, which contacts a pad on a magazine follower, which causes the first contact arm to pivot upward around the pivot pin, which in turn causes a second contact arm, which is also pivotally attached to the pivot point, to pivot upward.

9. The firearm of claim 8, wherein as the second contact arm pivots upward, it contacts a lip of the bolt catch, which causes the bolt catch to move upward to catch the bolt carrier.

10. The firearm of claim 9, wherein the bolt catch comprises an ambidextrous bolt catch release mechanism that enables a user to move the bolt catch to the down position on either side of the lower receiver.

11. The firearm of claim 9, wherein the lower receiver comprises an ambidextrous magazine release mechanism that enables a user to release a magazine from either side of the lower receiver.

12. The firearm of claim 1, further comprising:

a convertible stock comprising:

an elongated body having a first end and a second end, wherein the first end of the elongated body is attached to the firearm;

an axial disposed about the first end of the elongated body that the elongated body rotates about, wherein the convertible stock includes an unfolded position and a folded position, and a first locking assembly disposed about the first end of the elongated body for locking the convertible stock in the unfolded position, wherein the first locking assembly comprises a locking pin with a tab, wherein the tab is configured to mate with a slot in the first end of the elongated body, wherein the tab is maintained in the slot by a spring.

13. The firearm of claim 12, wherein the second end of the elongated body comprises a substantially traverse stabilizing member, wherein in the unfolded position, the stabilizing member functions as a buttstock, wherein in the folded position, the stabilizing member functions as a forward grip.

14. The firearm of claim 13, further comprising:

a second locking assembly for locking the convertible stock in the folded position, wherein the second lock assembly comprises a detent having a protrusion configured to mate with a slot in a forend of the firearm, wherein the stabilizing member includes a ledge with the detent partially extending therefrom, wherein the detent is maintained in the slot by a spring.

* * * * *